United States Patent [19]

Hall et al.

[11] 4,373,921

[45] Feb. 15, 1983

[54] OUTBOARD MOTOR WITH SEQUENTIALLY OPERATING TILT AND TRIM MEANS

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 173,160

[22] Filed: Jul. 28, 1980

[51] Int. Cl.[3] ..... B63H 21/26

[52] U.S. Cl. ..... 440/61; 248/641; 440/53

[58] Field of Search ..... 440/53, 55, 56–63, 440/900; 248/640–643

[56] References Cited

U.S. PATENT DOCUMENTS

| | | | |
|---|---|---|---|
| 2,954,192 | 9/1960 | Baird | 248/641 |
| 3,581,702 | 6/1971 | Moberg | 440/61 |
| 3,648,645 | 3/1972 | Ezell | 440/63 |
| 3,722,455 | 3/1973 | Carpenter | 440/61 |
| 3,847,198 | 11/1974 | Shimanekas | 440/61 |
| 3,855,517 | 5/1975 | Borst | 440/61 |
| 3,863,592 | 2/1975 | Borst | 440/61 |
| 3,983,835 | 10/1975 | Hall | 440/61 |
| 4,064,824 | 12/1977 | Hall | 440/61 |
| 4,096,820 | 6/1978 | Hall | 440/61 |
| 4,177,747 | 12/1979 | Pichl | 440/61 |

*Primary Examiner*—Trygve M. Blix
*Assistant Examiner*—D. W. Keen
*Attorney, Agent, or Firm*—Michael, Best & Friedrich

[57] ABSTRACT

Disclosed herein is a marine propulsion device comprising a transom bracket adapted to be connected to a boat transom, a stern bracket having an upper end, a first pivot connecting the upper end of the stern bracket to the transom bracket for pivotal movement of the stern bracket relative to the transom bracket about a first pivot axis which is horizontal when the transom bracket is boat mounted, a swivel bracket, a second pivot connecting the swivel bracket to the stern bracket below the first pivot for pivotal movement of the swivel bracket relative to the stern bracket about a second pivot axis parallel to the first pivot axis, a propulsion unit including, at the lower end thereof, a rotatably mounted propeller, a third pivot connecting the propulsion unit to the swivel bracket for steering movement of the propulsion unit relative to the swivel bracket about a generally vertical axis and for common pivotal movement with the swivel bracket in a vertical plane about the first and second horizontal axes, and a system for sequentially pivotally displacing the swivel bracket and connected propulsion unit about the second pivot axis and then about the first pivot axis.

7 Claims, 5 Drawing Figures

OUTBOARD MOTOR WITH SEQUENTIALLY OPERATING TILT AND TRIM MEANS

RELATED APPLICATIONS

Reference is hereby made to the following related applications, all of which are assigned to the assignee of this application and incorporated herein by reference:

Stevens application Ser. No. 159,480, filed June 16, 1980, and entitled OUTBOARD MOTOR WITH ELEVATED HORIZONTAL PIVOT AXIS Blanchard application Ser. No. 167,337, filed July 9, 1980, and entitled OUTBOARD MOTOR WITH DUAL TRIM AND TILT AXES Hall et al. application Ser. No. 173,159, filed July 28, 1980, and entitled OUTBOARD MOTOR WITH TILT LINKAGE INCLUDING PIVOT LINK Hall et al. application Ser. No. 173,158, filed July 28, 1980, and entitled MARINE PROPULSION DEVICE STEERING MECHANISM Hall et al. application Ser. No. 183,209, filed Sept. 2, 1980, and entitled HYDRAULIC SYSTEM FOR OUTBOARD MOTOR WITH SEQUENTIALLY OPERATING TILT AND TRIM MEANS Hall et al. application Ser. No. 173,162, filed July 28, 1980, and entitled LATERAL SUPPORT ARRANGEMENT FOR OUTBOARD MOTOR WITH SEPARATE TILT AND TRIM AXIS

BACKGROUND OF THE INVENTION

The invention relates generally to marine propulsion devices and, more particularly, to outboard motors including propulsion units which are steerable in a horizontal plane and tiltable in a vertical plane.

The invention also relates to arrangements for power tilting of propulsion units between a lower normal running position in which the propeller is submerged in water, and a tilted or raised position in which the propeller is located for above-the-water-accessability.

Various arrangements for power tilting and/or trimming of marine propulsion units are set forth in the following U.S. Pat. Nos.

| | | |
|---|---|---|
| Carpenter | 3,722,455 | March 27, 1973 |
| Shimanckas | 3,847,108 | November 12, 1974 |
| Borst | 3,863,592 | February 4, 1975 |
| Borst | 3,885,517 | May 27, 1975 |
| Hall | 3,983,835 | October 5, 1975 |
| Hall | 4,064,824 | December 27, 1977 |
| Hall | 4,096,820 | June 27, 1978 |
| Pichl | 4,177,747 | December 11, 1979 |

SUMMARY OF THE INVENTION

The invention provides a marine propulsion device comprising transom bracket means adapted to be connected to a boat transom, a stern bracket having an upper end, first pivot means connecting the upper end of the stern bracket to the transom bracket means for pivotal movement of the stern bracket relative to the transom bracket means about a first pivot axis which is horizontal when the transom bracket means is boat mounted, a swivel bracket, second pivot means connecting the swivel bracket to the stern bracket in spaced relation to the first pivot means for pivotal movement of the swivel bracket relative to the stern bracket about a second pivot axis parallel to the first pivot axis, a propulsion unit including, at the lower end thereof, a rotatably mounted propeller, means connecting the propulsion unit to the swivel bracket for steering movement of the propulsion unit relative to the swivel bracket about a generally vertical axis and for common pivotal movement with the swivel bracket in a vertical plane about the first and second horizontal axes, and means for sequentially pivotally displacing the swivel bracket and connected propulsion unit about the second pivot axis and then about the first pivot axis.

In one embodiment of the invention, wherein the swivel bracket and connected propulsion unit are moveable in a vertical plane between a lowermost running position with the propeller located in the water for driving propulsion and a raised position providing above water accessibility to the propeller, the pivotal displacement means comprises a hydraulic cylinder-piston assembly having a cylinder axis and opposite ends, first means pivotally connecting one of the ends to the transom bracket means, second means pivotally connecting the other of the ends to the swivel bracket, which first and second means connecting the cylinder-piston assembly ends are located such that, when the swivel bracket and connected propulsion unit are in the lowermost position, the ratio of perpendicular distances from the second pivot axis to the axis of the propeller and to the cylinder axis is less than the ratio of the perpendicular distances the first pivot axis to the axis of the propeller and to the cylinder axis.

In one embodiment of the invention, wherein the swivel bracket and connected propulsion unit are moveable in a vertical plane between a lowermost position with the propeller located in the water for driving propulsion and a raised position providing above water accessibility to the propeller, the pivotal displacement means comprises a tilt cylinder-piston assembly having an axis and opposite ends, a trim cylinder-piston assembly having an axis and opposite ends, first means pivotally connecting one of the ends of the tilt cylinder-piston assembly to the transom bracket means, second means pivotally connecting the other of the ends of the tilt cylinder-piston assembly to the stern bracket, third means pivotally connecting one of the ends of the trim cylinder-piston assembly to said stern bracket, and fourth means pivotally connecting the other of the ends of said trim cylinder-piston assembly to the swivel bracket, which first through fourth pivotal connecting means are located such that when the swivel bracket and connected propulsion unit are in the lowermost position, the ratio of the perpendicular distances from the second pivot axis to the axis of the propeller and to the axis of the trim cylinder-piston assembly is less than the ratio of the perpendicular distances from the first pivot axis to the axis of the propeller and to the axis of the tilt cylinder-piston assembly.

In one embodiment in accordance with the invention, wherein the swivel bracket and connected propulsion unit are moveable in a vertical plane between a lowermost position with the propeller located in the water for driving propulsion and a raised position providing above-water accessibility to the propeller, the pivotal displacement means comprises a tilt cylinder-piston assembly having an axis and opposite ends, first means pivotally connecting one of the ends of the tilt cylinder-piston assembly to the transom bracket means, second means pivotally connecting the other of the ends of the tilt cyliner-piston assembly to the swivel bracket, a trim cylinder-piston assembly having an axis and an extendable piston rod, means fixedly connecting the trim cylinder-piston assembly to one of the swivel bracket and the stern bracket for engagement of the piston rod with the other of the swivel bracket and the stern bracket and with the axis of the trim cylinder-piston assembly at a fixed perpendicular distance from the second pivot axis, which trim cylinder-piston assembly and which first and second pivotal connecting means are located such that, when the swivel bracket and connected propulsion unit are in the lowermost position, the ratio of the perpendicular distances from the first pivot axis to the axis of the propeller and to the axis of the tilt cylinder-piston assembly is less than the ratio of the perpendicular distances from the second pivot axis to the axis of the propeller and to the axis of the trim cylinder-piston assembly.

Other features and advantages of the embodiments of the invention will become known by reference to the following general description, claims and appended drawings.

IN THE DRAWINGS

FIG. 1 is a side elevational view of an outboard motor embodying various of the features of the invention.

Figure 4:
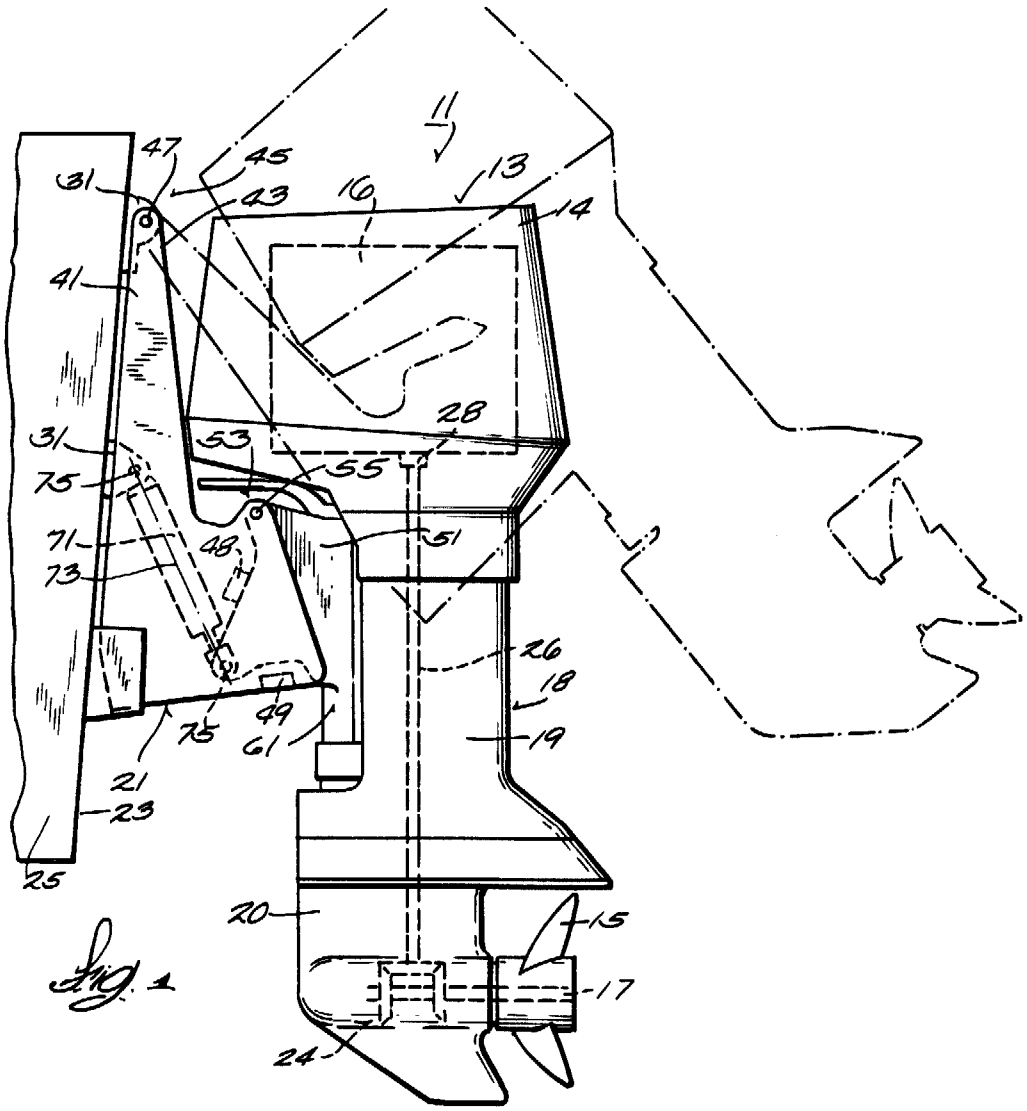
FIG. 4 is a fragmentary view similar to FIG. 2 showing the outboard motor in a fully tilted position.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device in the form of an outboard motor 11 having a generally conventional propulsion unit 13 including, at the lower end thereof, a rotably mounted propeller 15 driven by a propeller shaft 17. The outboard motor 11 also includes means 21 for pivotally mounting the propulsion unit 13 for pivotal movement in both the horizontal and vertical planes relative to a transom 23 of a boat 25, whereby to provide for steering movement of the propulsion unit in the horizontal plane, and to provide for movement in the vertical plane of the propulsion unit 13 between a lowermost position with the propeller 15 fully submerged in water for driving propulsion and a raised position affording above water accessibility to the propeller.

As is conventional, the propulsion unit 13 includes a power-head 14 provided with an internal combustion engine 16, together with a lower unit 18 which is fixed to the bottom of the power-head 14 and which includes a drive shaft housing 19 and a lower gear case or box 20 which supports the propeller shaft 17 carrying the propeller 15. The gear box 20 includes a suitable transmission 22 which connects the propeller shaft 17 to a drive shaft 26 which, in turn, is connected to the crankshaft 28 of the internal combustion engine 16.

The means 21 for pivotally mounting the propulsion unit 13 includes a transom bracket means 31 which can be of unitary construction or which can comprise several parts, and which is adapted to be fixedly mounted on the transom 23 of the boat 25.

The means 21 for pivotally mounting the propulsion unit 13 also includes an intermediate or stern bracket 41 having an upper end 43, as well as first pivot means 45 located rearwardly of the boat transom 23 and connecting the upper end 43 of the stern bracket 41 to the transom bracket means 31 for pivotal movement of the stern bracket 41 about a first or upper pivot axis 47 which is horizontal when the transom bracket means 31 is boat mounted. Any means for effecting such pivotal connection can be employed.

The means 21 for pivotally mounting the propulsion unit 13 further includes an intermediate or swivel bracket 51, together with second pivot means 53 connecting the swivel bracket 51 to the stern bracket 41 at a point below the first pivot means 45 for pivotal movement of the swivel bracket 51 relative to the stern bracket 41 about a second or lower pivot axis 55 which is parallel to the first pivot axis 47. Any means for effecting such pivotal connection can be employed.

Means are provided for limiting relative pivot movement between the swivel bracket 51 and the stern or intermediate bracket 41. While various arrangements can be employed, in the illustrated construction, such means comprises a pair of stops 48 and 49 on the stern bracket 41 in position to engage the swivel bracket 51 so as to limit relative travel therebetween and establish a trim range of positions of the propulsion unit 13.

The means 21 for pivotally mounting the propulsion unit 13 further includes means 61 for pivotally connecting the propulsion unit 13 to the swivel bracket 51 for movement in common with the swivel bracket 51 about the first and second or upper and lower pivot axis 47 and 55 and for steering movement of the propulsion unit 13 about a generally vertical axis relative to the swivel bracket 51. Any suitable means can be provided for pivotally connecting the swivel bracket 51 and the propulsion unit 13 and any suitable means can be employed for effecting steering displacement in a horizontal plane of the propulsion unit 13 relative to the swivel bracket 51.

Means are also provided for sequentially pivotally displacing the swivel bracket 51 and connected propulsion unit 13 about the second or lower horizontal pivot axis 55 through the trim range and subsequently about the first or upper horizontal pivot axis 47 through a tilt range limited by maximum extension of the cylinder-piston assembly 71. While various arrangements can be employed, in the construction illustrated in FIG. 1, such means comprises a hydraulic cylinder-piston assembly 71, having an axis 73 and opposed ends or eyes 75. One of the ends 75 is pivotally connected, by any suitable means, to the transom bracket means 31 and the other of the ends 75 is pivotally connected, by any suitable means, to the swivel bracket 51. If desired two hydraulic cylinder piston assemblies could be employed.

The pivotal connection of the ends 75 is such that, when the swivel bracket 51 and connected propulsion unit 13 are in their lowermost position as shown in FIG. 1, the ratio of perpendicular distances from the upper pivot or axis 47 to the axis of the propeller 15 and to the cylinder axis 73 is greater than the ratio of the perpendicular distances from the lower pivot or axis 55 to the axis of the propeller 15 and to the cylinder axis 73. In other words the mechanical advantage for the propeller thrust is greater about the upper or tilt axis 47 than about the lower or trim axis 55. Consequently, the swivel bracket 51 will pivot fully about the lower pivot or trim axis 55 before pivoting of the stern bracket 41 about the upper or first pivot or tilt axis 47. Thus, upon application of pressure fluid, by any suitable means, to the cylinder-piston assembly 71 to cause extension thereof, the swivel bracket 51 and connected propulsion unit 13 will initially tilt about the lower pivot axis 55 and subsequently tilt with the stern bracket 41 about the upper pivot axis 47. Initial tilting about the lower pivot axis 55 serves to retain the propulsion unit 13 in water for a longer interval during upward movement thereof through the trim range of positions and thereafter to more rapidly elevate the propulsion unit 13 from the water through the tilt range of positions.

Figures 2, 3, 4:
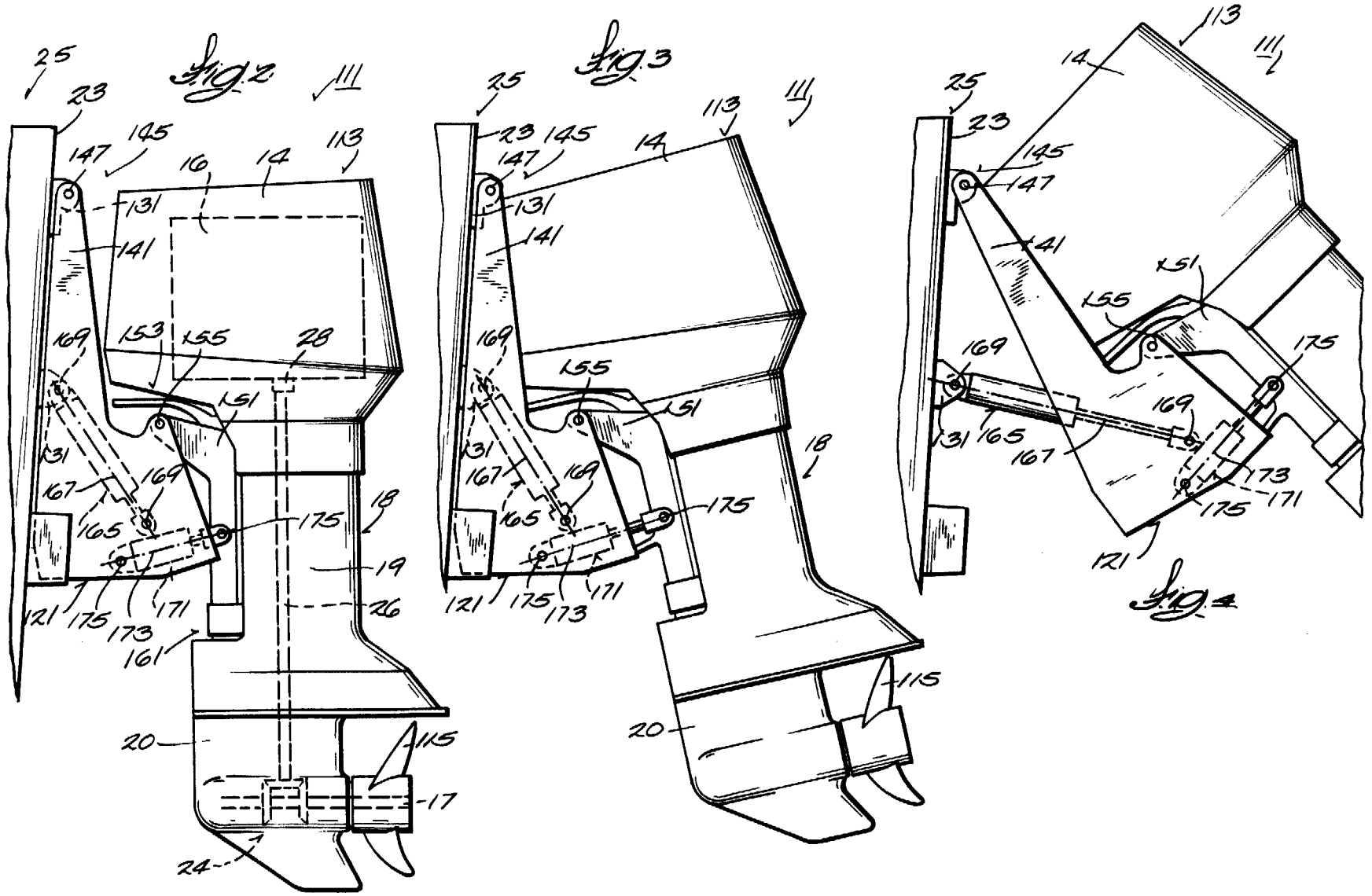
FIG. 2 is a side elevational view of another embodiment of an outboard motor which is shown in the running position, and which embodies various of the features of the invention.
FIG. 3 is a view similar to FIG. 2 with the outboard motor shown in the fully trimmed position.

Shown in FIGS. 2 through 4 is another marine propulsion device in the form of an outboard motor 111 which is constructed in a similar manner to the outboard motor 111 shown in FIG. 1 except for the arrangement for displacing the swivel bracket and connected propulsion unit between the lowermost and raised positions. The outboard motor 111 includes transom bracket means 131, together with means 121 for supporting a propulsion unit 113 for vertical and horizontal pivotal movement. Such means includes a stern bracket 141, an upper pivot means 145 pivotally connecting the stern bracket 141 to the transom bracket means 131 about a first horizontal or upper pivot axis 147, a swivel bracket 151, a lower pivot means 153 connecting the swivel bracket 151 and the stern bracket 141 about a second horizontal or lower pivot axis 155, and a pivotal steering connection 161 between the swivel bracket 151 and the propulsion unit 113.

The outboard motor 111 also includes means for sequentially displacing the swivel bracket 151 and connected propulsion unit 113 about the lower horizontal pivot axis 155 and then about the upper horizontal pivot axis 147. In the construction illustrated in FIGS. 2, 3 and 4, such means comprises a tilt hydraulic cylinder-piston assembly 165 having an axis 167 and opposed ends or eyes 169. One of the eyes 169 is pivotally connected, by any suitable means, to the transom bracket means 131, and the other of the eyes 169 is pivotally connected, by any suitable means, to the stern bracket 141.

In addition, the means for pivotally displacing the swivel bracket 151 and connected propulsion unit 113 includes a trim cylinder-piston assembly 171 having an axis 173 and opposed ends or eyes 175. One of the opposed ends 175 is pivotally connected, by any suitable means, to the stern bracket 141, and the other of the opposed ends 175 is suitably connected, by any suitable means, to the swivel bracket 151.

If desired, one of the ends 169 of the tilt cylinder-piston assembly 165 can be releasably connected to the associated bracket in the manner of a conventional reverse-lock so as to carry reverse thrust.

The pivotal connections of the trim cylinder-piston assembly 171 and the tilt cylinder-piston assembly 165 are located such that, when the swivel bracket 151 and connected propulsion unit 113 are in their lowermost position, the ratio of the perpendicular distances from the upper pivot axis 147 to the axis of the propeller 115 and to the axis 167 of the tilt cylinder piston assembly 165 is greater than the ratio of the perpendiculars distances from the lower pivot axis 173 to the axis of the propeller 115 and to the axis 167 of the trim cylinder-piston assembly 171. Consequently, upon the application of hydraulic pressure fluid to the trim cylinder-piston assembly 171 and tilt cylinder-piston assembly 165, by any suitable means, and assuming that the same pressure is applied to both cylinder assemblies and that both cylinder assemblies are of equal cross-sectional size, the swivel bracket 151 and propulsion unit 113 will initially tilt about the lower pivot axis 155 until the full extension of the trim cylinder piston assembly 171. Thereafter, the swivel bracket 151 and the connected propulsion unit 113, together with the stern bracket 141, will tilt about the upper pivot axis 147. Thus, in the construction shown in FIGS. 2, 3, and 4, the swivel bracket 151 and connected propulsion unit 113 initially tilt through a trim range about the lower horizontal pivot axis 155 and thereafter, together with the stern bracket 141, tilt through a tilt range about the upper horizontal pivot axis 147.

Sequential upward pivotal movement of the swivel bracket 151 and then of the stern bracket 141 can also be obtained when the previously mentioned ratio of the moment arms relative to the upper pivot or tilt axis 147 is equal to or greater than the previously mentioned ratio of the moment arms relative to the lower pivot or trim axis 155 by applying greater force along the axis 173 of the trim cylinder-piston assembly 171 as compared to along the axis 167 of the tilt cylinder-piston assembly 165. Such greater force can be obtained by increasing the cross sectional dimensions of the cylinder of the trim cylinder-piston assembly 171 as compared to the cylinder of the tilt cylinder-piston assembly 165 and/or by applying higher fluid pressure to the trim cylinder-piston assembly 171 as compared to the tilt cylinder-piston assembly 165.

Figure 5:
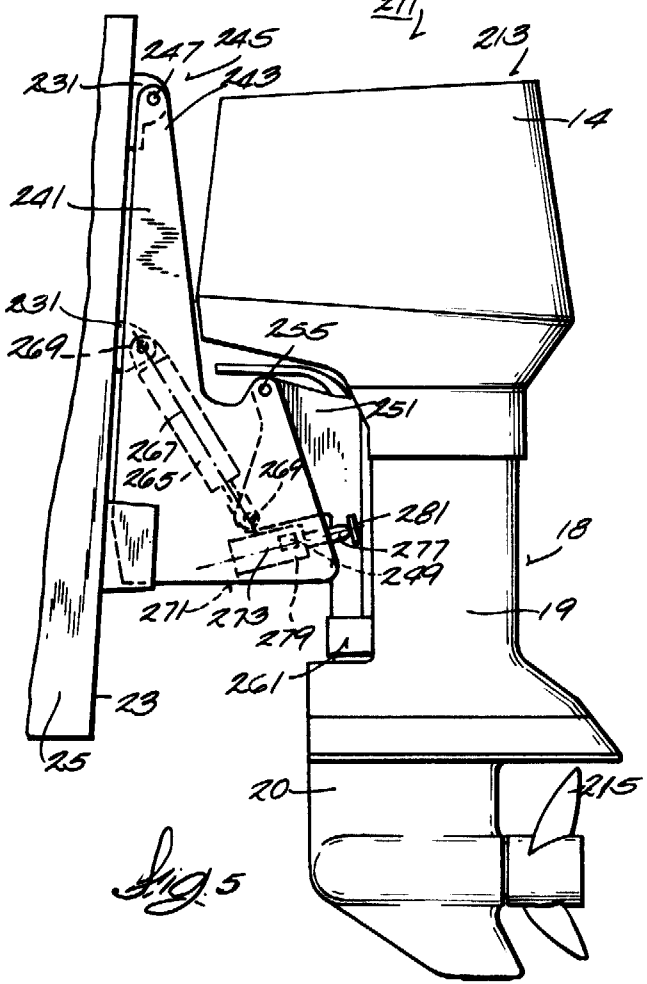
FIG. 5 is a side elevational view of still another embodiment of an outboard motor which embodies various of the features of the invention.

Shown in FIG. 5 is still another outboard motor 211 which is constructed in a similar manner to the outboard motor 11 shown in FIG. 1 except for the arrangement for pivotally displacing the swivel bracket and propulsion unit between the lowermost and raised positions. The outboard motor 211 shown in FIG. 5 includes transom bracket means 231, together with means for supporting a propulsion unit 213 for vertical and horizontal pivotal movement. Such means includes a stern bracket 241 connected at its upper end about a upper horizontal pivot axis 247 to the transom bracket means 231, a swivel bracket 251 connected about a second or lower horizontal pivot axis 255 to the stern bracket 241, and means 261 connecting the propulsion unit 213 to the swivel bracket 251 for common movement with the swivel bracket 251 in the vertical plane and for pivotal steering movement of the propulsion unit in the horizontal plane relative to the swivel bracket 251.

The outboard motor 211 also includes means for sequentially displacing the swivel bracket 251 and connected propulsion unit 213 about the lower horizontal axis 255 and then about the upper horizontal axis 247. In the construction illustrated in FIG. 5, such means comprises a tilt cylinder-piston assembly 265 having an axis 267 and opposed ends or eyes 269. One of the ends 269 is pivotally connected, by any suitable means, to the transom bracket means 251 and the other of the ends 269 is pivotally connected, by any suitable means, to the swivel bracket 251.

In addition, the means for displacing the swivel bracket 251 and connected propulsion unit 213 sequentially about the lower and upper pivot axis 255 and 247 includes a trim cylinder-piston assembly 271 which is fixedly mounted with respect to one of the swivel bracket 251 and stern bracket 241, and which includes a piston rod 277 which is extendable from a cylinder 279 which is adapted to engage the other of the swivel bracket 251 and stern bracket 241. In the illustrated construction, the trim cylinder-piston 271 assembly is fixed relative to the stern bracket 241 and the piston rod 277 engages a pad 281 on the swivel bracket 251. A stop 249 is desireably provided to limit upward pivotal movement of the swivel bracket 251 relative to the stern bracket 241.

Reverse thrust is carried about both the tilt axis 247 and the trim axis 255 by the tilt cylinder-piston assembly 265. If desired some form of releasable reverse lock can be employed at one of the ends of the tilt cylinder-piston assembly 265.

The location of the axis 273 of the trim cylinder-piston assembly 271 and the location of the pivotal connections of the tilt cylinder-piston assembly 265 to the transom bracket means 231 and the stern bracket 241 are such that, when the swivel bracket 251 and connected propulsion unit 213 are in the lowermost position, the ratio of the perpendicular distances from the upper horizontal pivot axis 247 to the axis of the propeller 215 and to the axis 267 of the tilt cylinder-piston assembly 265 is greater than the ratio of the perpendicular distances from the lower or second horizontal pivot axis 255 to the axis of the propeller 215 and to the axis 273 of the fixed trim cylinder-piston assembly 271. Consequently, upon the application of pressure fluid to the tilt cylinder-piston assembly 265 and to the trim cylinder-piston assembly 271, by any suitable means, and assuming a common pressure and a common cylinder cross-section, the swivel bracket 251 and connected propulsion unit 213 will initially be caused to tilt about the lower pivot axis 255 and, upon full extension of the piston rod 277 from the trim cylinder 279, to then tilt with the stern bracket 241, about the upper horizontal axis 247. Upon return movement, the propulsion unit 213 initially tilts about the upper horizontal pivot 247 and subsequently tilts about the lower horizontal pivot 255.

If desired and as indicated in connection with the embodiment of FIGS. 2 through 4, the force applied by the trim cylinder-piston assembly 271 as compared to the tilt cylinder-piston assembly 265 can be increased in order to obtain the desired sequential upward propulsion unit pivotal movement when other arrangements for locating the trim and tilt cylinder-piston assemblies 271 and 265 are employed.

Various features of the invention are set forth in the following claims.

We claim:

1. A marine propulsion device comprising a transom bracket means adapted to be connected to a boat transom, a stern bracket having an upper end, first pivot means connecting said upper end of said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket below said first pivot means for pivotal movement of said swivel bracket relative to said stern bracket about a second pivot axis parallel to said first pivot axis, a propulsion unit including, at the lower end thereof, a rotatably mounted propeller, means connecting said propulsion unit to said swivel bracket for steering movement of said propulsion unit relative to said swivel bracket about an axis which is transverse to said first and second axes and for common pivotal movement with said swivel bracket in a vertical plane about said first and second horizontal axes, and means for sequentially pivotally displacing said swivel bracket and connected propulsion unit about said second pivot axis and then about said first pivot axis.

2. A marine propulsion device in accordance with claim 1 wherein said swivel bracket and connected propulsion unit are moveable in a vertical plane between a lowermost position with said propeller located in the water for driving propulsion and a raised position providing above water accessibility to said propeller, wherein said pivotal displacement means comprises a hydraulic cylinder-piston assembly having a cylinder axis and opposite ends, first means pivotally connecting one of said ends to said transom bracket means, second means pivotally connecting the other of said ends to said swivel bracket, said first and second means connecting said cylinder-piston assembly ends being located such that, when said swivel bracket and connected propulsion unit are in said lowermost position, the ratio of the perpendicular distances from said second pivot axis to the axis of said propeller and to said cylinder axis is less than the ratio of the perpendicular distances from said first pivot axis to the axis of said propeller and to said cylinder axis.

3. A marine propulsion device in accordance with claim 1 wherein said swivel bracket and connected propulsion unit are moveable in a vertical plane between a lowermost position with said propeller located in the water for driving propulsion and a raised position providing above water accessibility to said propeller, and wherein said pivotal displacement means comprises a tilt cylinder-piston assembly having an axis and opposite ends, a trim cylinder-piston assembly having an axis and opposite ends, first means pivotally connecting one of said ends of said tilt cylinder-piston assembly to said transom bracket means, second means pivotally connecting the other of said ends of said tilt cylinder-piston assembly to said stern bracket, third means pivotally connecting one of said ends of said trim cylinder-piston assembly to said stern bracket, and fourth means pivotally connecting the other of said ends of said trim cylinder-piston assembly to said swivel bracket, said first through fourth pivotal connecting means being located such that when said swivel bracket and connected propulsion unit are in said lowermost position, the ratio of the perpendicular distances from said second pivot axis to the axis of said propeller and to said axis of said trim cylinder-piston assembly is less than the ratio of the perpendicular distances from said first pivot axis to the axis of said propeller and to said axis of said tilt cylinder-piston assembly.

4. A marine propulsion device in accordance with claim 1 wherein said swivel bracket and connected propulsion unit are moveable in a vertical plane between a lowermost position with said propeller located in the water for driving propulsion and a raised position providing above water accessibility to said propeller, and wherein said pivotal displacement means comprises a tilt cylinder-piston assembly having an axis and opposite ends, first means pivotally connecting one of said ends of said tilt cylinder-piston assembly to said transom bracket means, second means pivotally connecting the other of said ends of said tilt cylinder-piston assembly to said swivel bracket, a trim cylinder-piston assembly having an axis and an extendable piston rod, means fixedly connecting said trim cylinder-piston assembly to one of said swivel bracket and said stern bracket for engagement of said piston rod with the other of said swivel bracket and said stern bracket and with said axis of said trim cylinder-piston assembly at a fixed perpendicular distance from said second pivot axis, said trim cylinder-piston assembly and said first and second pivotal connecting means being located such that, when said swivel bracket and connected propulsion unit are in said lowermost position, the ratio of the perpendicular distances from said first pivot axis to the axis of the propeller and to said axis of said tilt cylinder-piston assembly is less than the ratio of the perpendicular distances from said second pivot axis to the axis of the propeller and to said axis of said trim cylinder-piston assembly.

5. A marine propulsion device in accordance with claim 1 wherein said first pivot is located rearwardly of the boat transom.

6. A marine propulsion device comprising a transom bracket means adapted to be connected to a boat transom, a stern bracket having an upper end, first pivot means connecting said upper end of said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket in spaced relation from said first pivot means and for pivotal movement of said swivel bracket relative to said stern bracket about a second pivot axis parallel to said first pivot axis, a propulsion unit including, at the lower end thereof, a rotatably mounted propeller, means connecting said propulsion unit to said swivel bracket for steering movement of said propulsion unit relative to said swivel bracket about a generally vertical axis and for common pivotal movement with said swivel bracket in a vertical plane about said first and second horizontal axes, and means for sequentially pivotally displacing said swivel bracket and connected propulsion unit about said second pivot axis and then about said first pivot axis.

7. A marine propulsion device comprising a transom bracket means adapted to be connected to a boat transom, a stern bracket having an upper end, first pivot means connecting said upper end of said stern bracket to said transom bracket means for pivotal movement of said stern bracket relative to said transom bracket means about a first pivot axis which is horizontal and rearward of the transom when said transom bracket means is boat mounted, a swivel bracket, second pivot means connecting said swivel bracket to said stern bracket in spaced relation from said first pivot means and for pivotal movement of said swivel bracket relative to said stern bracket about a second pivot axis parallel to said first pivot axis, a propulsion unit including, at the lower end thereof, a rotatably mounted propeller, means connecting said propulsion unit to said swivel bracket for steering movement of said propulsion unit relative to said swivel bracket about a generally vertical axis and for common pivotal movement with said swivel bracket in a vertical plane about said first and second horizontal axes, and means for sequentially pivotally displacing said swivel bracket and connected propulsion unit about said second pivot axis and then about said first pivot axis.

* * * * *